US006427054B1

(12) United States Patent
Ohkubo et al.

(10) Patent No.: US 6,427,054 B1
(45) **Date of Patent: *Jul. 30, 2002**

(54) IMAGE FORMING APPARATUS INDICATING THE RESIDUE OF TONER AND THE DEFICIENCY OF TONER

(75) Inventors: Masaharu Ohkubo, Yokohama; Minoru Matsuguma, Susono, both of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/033,583

(22) Filed: Mar. 3, 1998

(30) Foreign Application Priority Data

Mar. 6, 1997 (JP) ..... 9-069069

(51) Int. Cl.[7] ..... G03G 15/00
(52) U.S. Cl. ..... 399/27
(58) Field of Search ..... 399/25, 26, 27, 399/110, 111, 119, 258, 81

(56) References Cited

U.S. PATENT DOCUMENTS 4,626,096 A * 12/1986 Ohtsuka et al. ..... 399/27
4,961,088 A * 10/1990 Gilliland et al. ..... 399/25
4,977,429 A * 12/1990 Tani et al. ..... 399/27
5,101,233 A * 3/1992 Ito et al. ..... 399/26
5,105,219 A * 4/1992 Yoshikado ..... 399/27
5,160,966 A * 11/1992 Shiina et al. ..... 399/27
5,204,699 A * 4/1993 Birnbaum et al. ..... 399/27
5,349,377 A * 9/1994 Gilliland et al. ..... 399/181
5,794,094 A * 8/1998 Boockholdt et al. ..... 399/27
5,802,420 A * 9/1998 Garr et al. ..... 399/27
5,970,275 A * 10/1999 Brown Jr. et al. ..... 399/27

* cited by examiner

*Primary Examiner*—William J. Royer
(74) *Attorney, Agent, or Firm*—Fitzpatrick, Cella, Harper & Scinto

(57) ABSTRACT

An image forming apparatus includes an image bearing member, an electrostatic image forming device for forming an electrostatic image based on an image signal on the image bearing member, a developing device for developing the electrostatic image on the image bearing member, a detector for detecting the amount of a toner in the developing device, an integrating device for integrating a number of image signals produced by the apparatus, and an estimator for estimating and indicating whether the apparatus has consumed a predetermined amount of toner, on the basis of the integrated amount integrated by the integrating device before the detector detects the consumption of all the toner.

10 Claims, 3 Drawing Sheets

IMAGE FORMING APPARATUS INDICATING THE RESIDUE OF TONER AND THE DEFICIENCY OF TONER

BACKGROUND OF THE INVENTION

1. Field of the Invention

This invention relates to an image forming apparatus of the electrophotographic type or the electrostatic recording type, and particularly to an image forming apparatus of the digital type forming an image on the basis of an image signal.

2. Related Background Art

For example, an image forming apparatus, such as an electrophotographic printer, effects selective exposure on an electrophotographic photosensitive member, e.g. a photosensitive drum uniformly charged by a charger, by exposure means to thereby form a latent image, visualizes this latent image into a toner image by a developer (hereinafter referred to as the "toner") contained in a developing device and also, transfers this toner image to a recording medium and effects image recording. In such an image forming apparatus, it has heretofore been practiced to detect the residue of toner in the developing device by the use of detecting means.

Also, in the image forming apparatus as described above, each time the toner is exhausted, the supply of the toner into the developing device must be effected, but this work of supplying the toner is not only cumbersome, but also results in contamination. Also, the maintenance of the apparatus can be done only by a professional serviceman and has often involved inconveniences to a user.

So, a cartridge comprising a photosensitive drum, a charger, a developing device, a cleaning portion, etc. united into an integral structure has been put into practical use. In such an apparatus, a user loads the apparatus body with such a process cartridge to thereby make the supply of a toner or the interchange of a part such as a photosensitive drum which has come to the end of its service life possible and thus, maintenance becomes easy.

On the other hand, in an image forming apparatus of such a cartridge type, when the toner in the cartridge has become exhausted, it is necessary to interchange the cartridge. Accordingly, heretofore, detecting means for informing the user of the interchange of the cartridge has been provided in a developing device containing toner therein. As the detecting means, there is, for example, one of the piezoelectric sensor type, the magnetic sensor type or like type, but when an AC bias is applied to a developing sleeve for supplying a toner to a photosensitive drum, use is usually made of an antenna sensing type in which a metallic bar (antenna) is disposed in proximity and in parallel with the developing sleeve and the amount of remaining toner in the developing device is detected by a change in electrostatic capacity.

However, such a residue detecting system only indicates the exhaustion of the toner, and does not prepare the user for the replenishment of toner and the use of a substitute cartridge, and therefore could be improved.

It is also conceivable to detect the state when the toner is being exhausted, but this will complicate the detecting mechanism.

SUMMARY OF THE INVENTION

It is an object of the present invention to provide an image forming apparatus which can indicate the residue of toner before the toner becomes deficient.

It is another object of the present invention to provide an image forming apparatus in which the approximate amount of toner can be known to a user.

It is still another object of the present invention to provide an image forming apparatus having:

an image bearing member;

electrostatic image forming means for forming an electrostatic image basd on an image signal on the image bearing member;

developing means for developing the electrostatic image on the image bearing member;

deficiency detecting means for detecting the deficiency of a toner in the developing means;

integrating means for integrating the number of image signals; and residue indicating means for indicating the residue of the toner before the deficiency detecting means detects the deficiency of the toner, on the basis of the integrated amount by the integrating means.

Further objects of the present invention will become apparent from the following description.

DESCRIPTION OF THE PREFERRED EMBODIMENTS

An image forming apparatus according to the present invention will hereinafter be described in detail with reference to the drawings.

Embodiment 1

Figure 1:
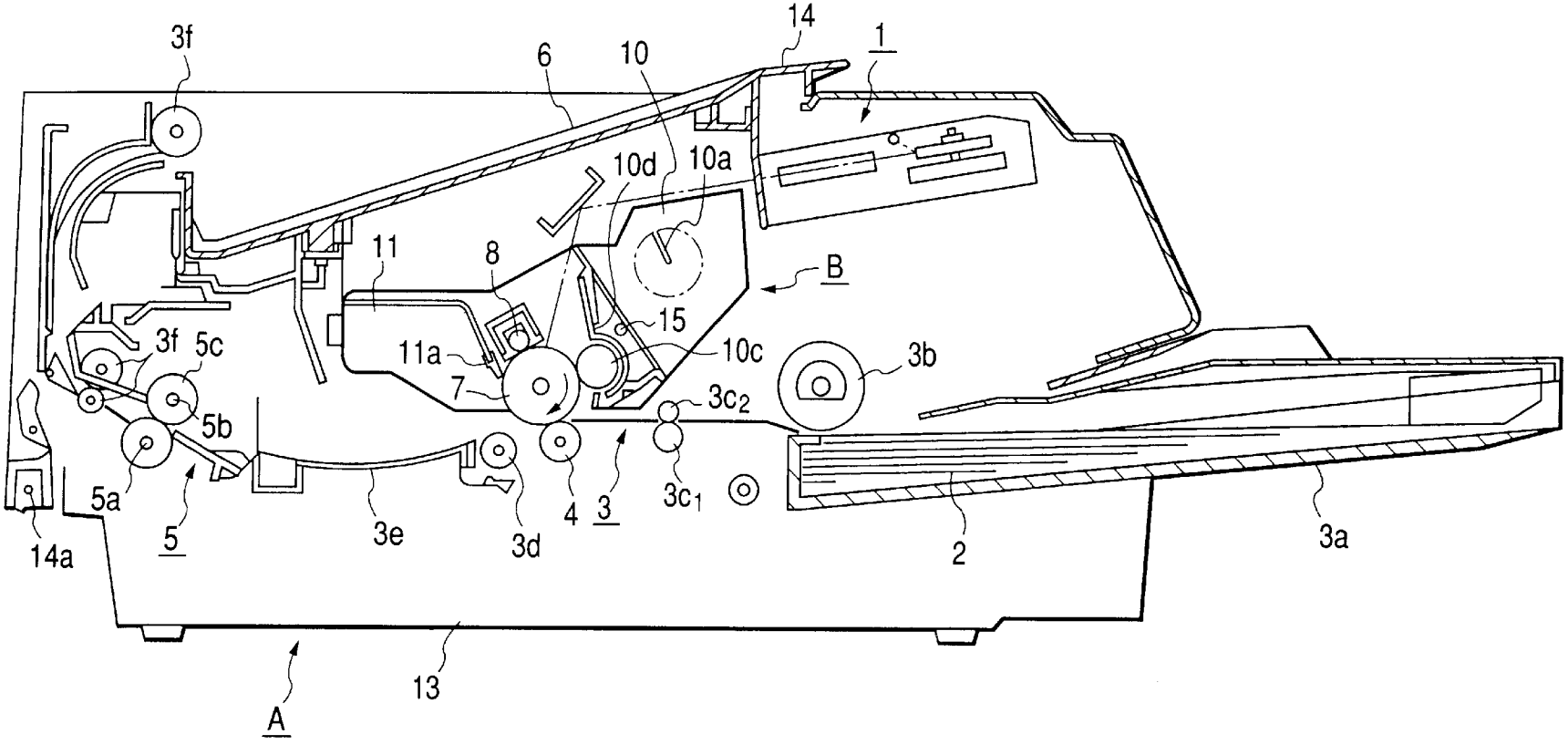
FIG. 1 is a cross-sectional view of an image forming apparatus according to an embodiment of the present invention.
Figure 2:
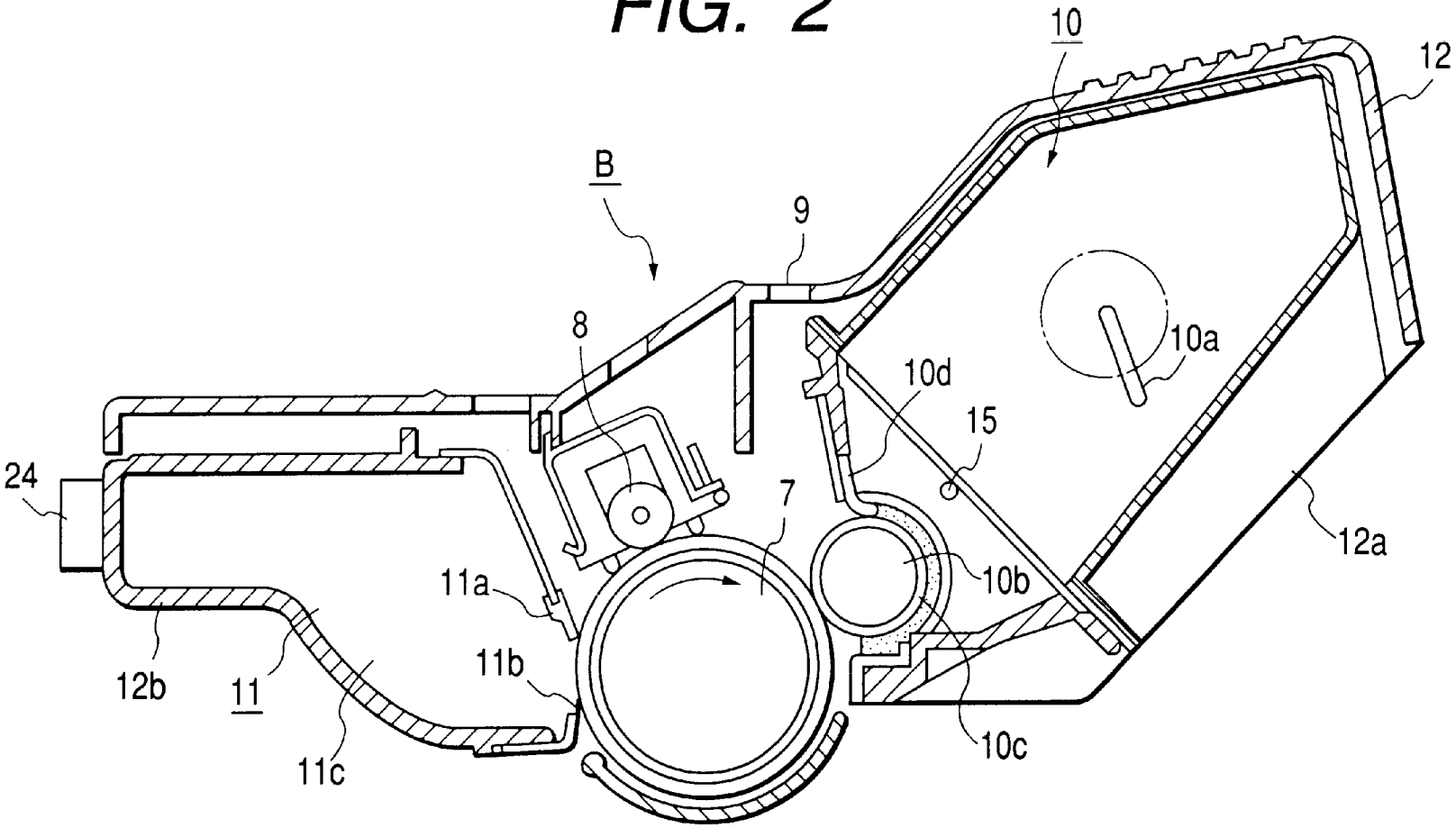
FIG. 2 is a cross-sectional view of a process cartridge removably mountable on the image forming apparatus shown in FIG. 1.

FIG. 1 schematically shows the general construction of an embodiment of the image forming apparatus of the present invention. In this embodiment, the image forming apparatus is a laser beam printer of the electrophotographic type on which a process cartridge is mountable. FIG. 2 is an illustration of the construction of the process cartridge.

In the description of the present embodiment, the general construction of the image forming apparatus having the process cartridge mounted thereon will first be described, and then the construction for detecting the service life of the process cartridge will be described. Also, in the present invention, the process cartridge refers to at least a developing device and a photosensitive member integrally made into a cartridge removably mountable on an image forming apparatus body.

In the present embodiment, the image forming apparatus A, as shown in FIG. 1, has a process cartridge B forming an image forming portion. In the present embodiment, the process cartridge, as shown in FIGS. 1 and 2, rotatably carries a photosensitive drum 7 having a photosensitive layer. The surface of the photosensitive drum 7 is uniformly charged by the application of a voltage to a charging roller 8 which is charging means. On the other hand, an optical image is applied from the optical system 1 of laser beam exposure means to the photosensitive drum 7 through an exposure portion 9, whereby a latent image is formed on the photosensitive drum 7. This latent image is developed into a toner image by a developing device, i.e., developing means 10, integrally formed in the cartridge.

That is, this developing device 10 feeds out toner in a toner reservoir containing the toner therein by a toner feeding member 10*a,* rotates a developing sleeve 10*c* containing a fixed magnet 10*b* therein and also forms a toner layer having frictional electrification charges imparted thereto on the surface of the developing sleeve 10*c* by a developing blade 10*d,* and transfers the toner to the photosensitive drum 7 in conformity with the aforementioned latent image to thereby form a visible toner image.

On the other hand, in synchronism with the formation of the toner image, a recording medium 2 such as transfer paper is conveyed from a cassette 3*a* by conveying means 3 comprising a pick-up roller 3*b* and a pair of register rollers 3*c*1 and 3*c*2. The toner image formed on the photosensitive drum is transferred to the recording medium 2 with a voltage opposite in polarity to the toner image applied to a transfer roller 4 as transfer means, and the recording medium 2 is conveyed to fixation means 5 by an intermediate discharge roller 3*d* and a guide plate 3*e*. This fixation means 5 comprises a driving roller 5*a* and a fixating roller 5*c* containing a heater 5*b* therein, and applies heat and pressure to the passing recording medium 2 to thereby fix the transferred toner image. This recording medium 2 is then conveyed by discharge rollers 3*f* and is discharged onto a discharge portion 6 through a reversely conveying route.

After the toner image has been transferred to the recording medium 2, the photosensitive drum 7 has any residual toner thereon scraped off by a cleaning blade 11*a* and is scooped by a scooping sheet 11*b,* and the residual toner on the photosensitive drum 7 is removed by cleaning means 11 for collecting the residual toner into a waste toner reservoir 11*c*.

The parts such as the photosensitive drum 7 and the developing device 10 are contained in a housing 12 comprising a first frame body 12*a* and a second frame body 12*b* coupled together to form a cartridge, which is removably mounted with respect to a cartridge mounting means provided in an apparatus body 13.

The cartridge mounting means, when an openable-closable member 14 is opened about a shaft 14*a*, has cartridge mounting guide members, not shown, mounted on the left and right inner sides of the openable-closable member 14, and guide portions for inserting the process cartridge B are provided in the left and right guide members in opposed relationship with each other. The process cartridge B is inserted along these guide portions and the openable-closable member 14 is closed, whereby the process cartridge B can be mounted on the image forming apparatus A.

A description will now be made of a method of detecting the consumption level of the toner, i.e., the residue of the toner, and detecting the absence of the toner.

Figure 3:
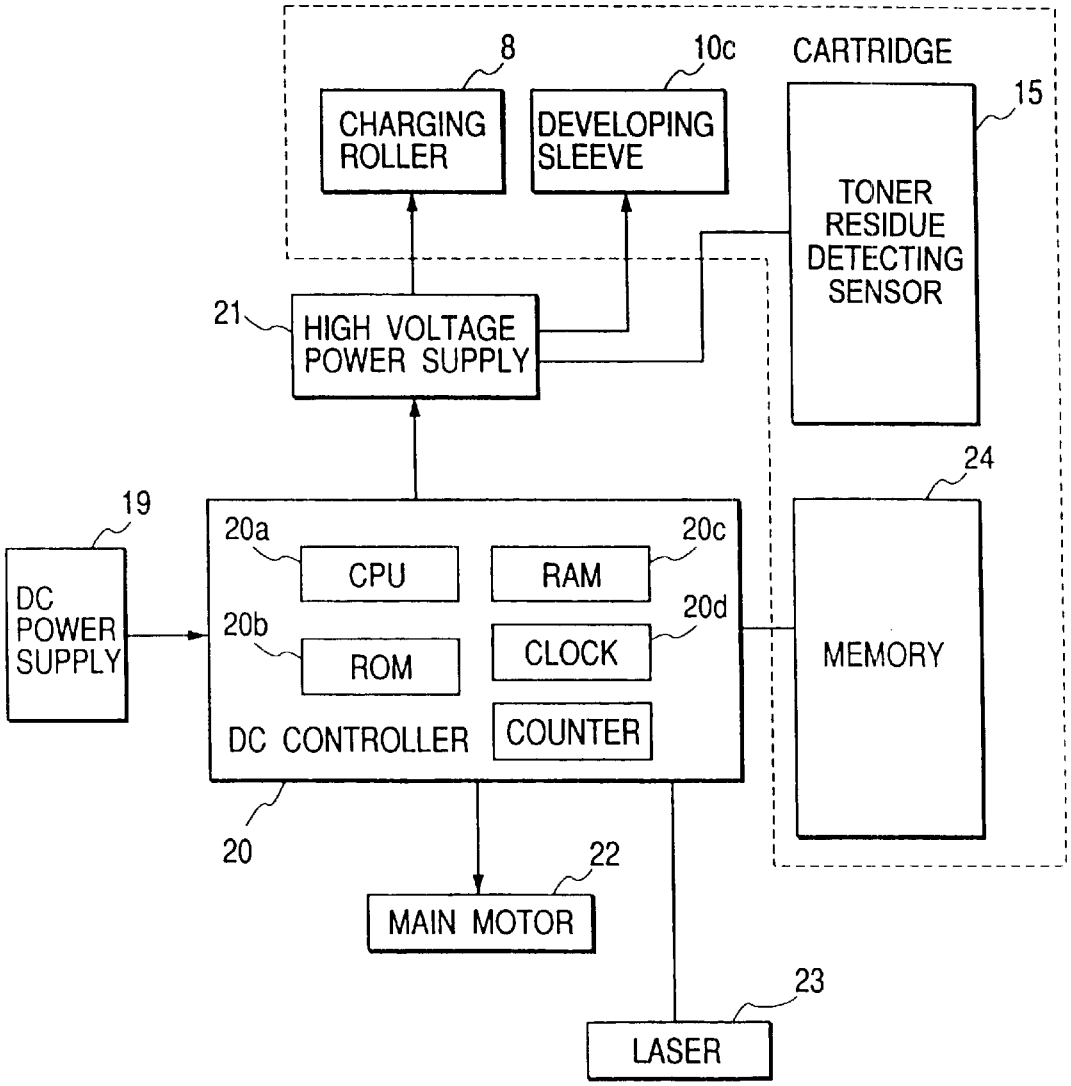
FIG. 3 is a block diagram of the embodiment of the present invention.

FIG. 3 is a diagram for illustrating the control of the laser beam printer using the present invention. In FIG. 3, a DC power supply source 19 produces a predetermined voltage and supplies the DC voltage to each unit. A DC controller 20 controls the driving of the entire apparatus, and has therein a CPU 20*a*, a ROM 20*b*, a RAM 20*c* and a clock circuit 20*d* for producing a clock. The DC controller 20 also controls a high voltage power supply source 21 for the charging roller 8 and the developing sleeve 10*c,* and further controls the driving of a main motor 22 for rotating the photosensitive drum 7.

Also, a laser 23 for scanning and exposing the surface of the photosensitive drum is controlled so as to produce a constant quantity of light by the DC controller 20 and has its turned-on state controlled in conformity with an image signal.

In the present embodiment, a metal bar (lead wire) having a diameter of 1 to 2 mm is used as toner residue detecting means 15 for the developing device 10, and there is adopted a so-called antenna system in which it is extended parallel to the developing sleeve 10*c* and detects a change in capacity between it and the developing sleeve 10*c*.

For example, the toner consumption rate of a standard image of the turn-on ratio 4% of the laser to a page of A4 size is about 0.05 g/sheet. If the laser is turned on by this ratio, the toner is consumed in conformity therewith. Accordingly, if the turn-on time of the laser or the black portion of the image signal is counted and integrated, the amount of consumed toner in the developing device 10 of the cartridge B will become known, and if the amount of consumed toner is subtracted from the amount of toner initially contained in the developing device 10, the residue of toner in the developing device 10 will become known. Thus, when the controller 20 is used this way, the cartridge also includes means for estimating and indicating whether the apparatus has consumed a predetermined amount of toner.

According to this toner residue detecting method, depending on whether the actually printed image is a text (line image) or a photographic image, and also on the environment of use (temperature and humidity), the amount of used toner sometimes fluctuates by 50% or so at greatest and thus, the detection accuracy thereof is inferior to a system for directly detecting the residue of toner by a sensor. However, the rough value of the amount of used toner can be continuously indicated, for example, at the points ¾, ½ and ¼ of the amount of residual toner. When the amount of residual toner has become ¾, ½ and ¼, it is displayed on a display portion, not shown, and a signal is transmitted to a computer connected to the apparatus. This data of the amount of used toner is written into a memory 24 carried on the cartridge B so as to be preserved even after the cartridge has been interchanged.

When the cartridge B is further used and the toner in the developing device 10 is consumed, the possibility of an image being broken is detected by the toner residue detecting means 15 installed in the developing device 10 in the cartridge B and a signal for interchanging the cartridge B with a new one is produced. According to the toner residue detecting method using this toner residue detecting means 15, the amount of toner can be directly detected and therefore reliability is high.

According to the toner residue detecting method conforming to the above-described construction of the present invention, a cartridge interchanging signal is not abruptly outputted as in the method according to the prior art, but the used state of the cartridge can be sequentially known and this is very convenient to the user.

In the present embodiment, the memory 24 carried on the above-described cartridge is connected to the apparatus body by a connector, and this memory is a rewritable ROM and the information of the cartridge is sequentially stored therein. However, in a printer wherein the cartridge is less often interchanged, it is possible to use the memory on the apparatus body side in lieu of this memory 24.

In the foregoing description of the embodiment, the image forming apparatus is a printer in which the developing device 10 is made into an integral type cartridge with the photosensitive drum 7, etc., and the cartridge has been described as being interchanged with a new one, but the image forming apparatus may be a printer of a type in which the developing device is replenished with the toner when the toner is consumed. In this case, the laser count is discontinued each time the toner is supplied, and after the supply of the toner, the laser count is newly started and the used state of the toner is displayed. Of course, even when the developing device 10 is formed separately from the photosensitive drum 7, the laser count can be discontinued each time the toner is supplied, and after the supply of the toner, the laser count can be newly started and the used state of the toner can be displayed.

Also, the present invention is applicable to a case where the image forming apparatus is neither of the above-described integral cartridge type nor the replenishment type, but is of a used-up developing device type. In this case, when the developing device is interchanged, the laser count is discontinued, and after the interchange, the laser count is newly effected.

A description will now be provided of a method of improving the accuracy of a method of estimating the amount of used toner by the laser count.

A text image is usually associated with a 4% laser turn-on ratio for A4 size or letter size paper, and can be associated with up to a 6% laser turn-on ratio. Accordingly, when the laser turn-on ratio or print rate of a page exceeds 8 to 15%, it is presumed that many half-tone images such as photographs and half tone dot meshing are included in the images. In the case of half-tone images, the amount of consumed toner is small as compared with a text of the same print rate and therefore, the amount of consumed toner for only a text image is multiplied by a value of 0.6 to 0.9.

As described above, the extent of the image on a page is estimated from the print rate in that page, and correction is applied to the amount of consumed toner, whereby a nearly practical amount of consumed toner can be estimated by simple logic which does not require much cost.

Embodiment 2

In the above-described Embodiment 1, there has been adopted a construction in which the rough amount of used toner in the integral type cartridge is indicated by the laser count and a signal indicative of the interchange of the developing device or the cartridge is produced by the toner residue detecting means, and there can further be adopted a construction in which the remaining life of the photosensitive drum 7 is calculated on the basis of the number of revolutions of the photosensitive drum 7 so that a signal for the interchange of the cartridge may be produced.

In the printer using the integral type cartridge as shown in FIGS. 1 and 2, there is a case where the service life of the photosensitive drum 7 is shorter than the time required for the toner in the developing device 10 in the cartridge to be exhausted.

Accordingly, in order to cope with such a case, it is necessary to watch the amount of used toner and the amount of use of the photosensitive drum and indicate the used state of the cartridge.

While the amount of use of the photosensitive drum 7 can be calculated on the basis of the time for which electric power is supplied to a main motor 22 shown in FIG. 3 for driving the photosensitive drum, it is preferable to calculate the amount of use by applying a correction by the time for which an AC voltage is applied to the charging roller 8.

That is, as a specific example in this embodiment, both of the amount of use of the photosensitive drum 7 and the amount of use of the toner are displayed at the points ¼, ½ and ¾. When the toner residue detecting means 15 detects the exhaustion of the toner or the rotation time of the photosensitive drum 7 exceeds a predetermined time, signals indicative of "no toner" and "expiration of drum life" are produced.

Further, according to another specific example of the present embodiment, when one of the amount of use of the photosensitive drum 7 and the amount of use of the toner has reached the amounts of use of ¼, ½ and ¾, it is displayed that the amount of use of the developing device or the cartridge has reached ¼, ½, and ¾. Thus, when the toner residue detecting means has detected "no toner" or a signal indicating that the rotation time of the photosensitive drum has exceeded a predetermined time has been outputted, a signal for the interchange of the developing device or the cartridge is produced.

While the former specific example enables the state of the cartridge to be known in detail, the latter specific example is more useful to the user.

While the embodiments of the present invention have been described above, the present invention is not restricted to these embodiments, but all modifications thereof within the technical idea of the present invention are possible.

What is claimed is:

1. An image forming apparatus comprising:

an image bearing member;

electrostatic image forming means for forming an electrostatic image based on an image signal on said image bearing member;

developing means for developing the electrostatic image on said image bearing member with a toner;

integrating means for integrating the number of image signals;

a toner sensor for detecting an amount of toner in said developing means;

shortage-of-toner indicating means for indicating the need for replenishment of the toner or an exchange of said developing means when said toner sensor detects a shortage of the toner; and remaining amount indicates means for indicating a remaining amount of the toner step-by-step based on an integrated value of said integrating means before said toner sensor detects the shortage of the toner.

2. An image forming apparatus according to claim 1, wherein said image bearing member and said developing means are provided in a cartridge detachably mountable in a main body of said apparatus, and said appararus produces an interchange command signal for the cartridge when said toner sensor detects the shortage of the toner.

3. An image forming apparatus according to claim 2, wherein said cartridge includes a memory for storing therein the integrated amount of the image signals.

4. An image forming apparatus according to claim 1, wherein said integrating means corrects the number of image signals in conformity with the kind of the formed image.

5. An image forming apparatus according to claim 4, wherein said integrating means corrects the integrated number of image signals by the number of image signals corresponding to one page.

6. A detecting method for detecting an amount of toner in a developing apparatus, comprising:

a storing step for storing integrating information with respect to the number of image signals for forming an electrostatic image on an image bearing body;

a detecting step for detecting whether the toner is present or absent in the developing apparatus;

a toner absent indicating step for indicating that the toner is absent when it is detected, by said detecting step, that the toner is absent; and a remaining amount indicating step for indicating the remaining amount of the toner, based on the integrating information, before it is detected by said detecting step that the toner is absent.

7. A detecting method according to claim 6, wherein said detecting step is effected by a toner sensor.

8. A detecting method according to claim 6, wherein the image bearing body and the developing apparatus are provided in a process cartridge detechably attachable to a main body of an image forming apparatus, and wherein a signal for exchanging said process cartridge is generated when it is detected, by said detecting step, that the toner is absent.

9. A detecting method according to claim 8, wherein said storing step is effected by a memory provided on said process cartridge.

10. A detecting method according to claim 6, wherein the integrating information is corrected in accordance with the number of the image signals corresponding to one page.

* * * * *

UNITED STATES PATENT AND TRADEMARK OFFICE

CERTIFICATE OF CORRECTION

PATENT NO. : 6,427,054 B1
DATED : July 30, 2002
INVENTOR(S) : Ohkubo et al.

It is certified that error appears in the above-identified patent and that said Letters Patent is hereby corrected as shown below:

Column 6,
Line 33, "indicates" should read -- indicating --.

Signed and Sealed this

Twenty-second Day of April, 2003

JAMES E. ROGAN
*Director of the United States Patent and Trademark Office*